US011350743B2

(12) United States Patent
Reinhart et al.

(10) Patent No.: US 11,350,743 B2
(45) Date of Patent: Jun. 7, 2022

(54) SHELF ASSEMBLY

(71) Applicant: CREATIVE PLASTIC CONCEPTS, LLC, Sycamore, OH (US)

(72) Inventors: Nickolas Reinhart, Findlay, OH (US); Jacob H. Whitta, Findlay, OH (US)

(73) Assignee: CREATIVE PLASTIC CONCEPTS, LLC, Sycamore, OH (US)

( * ) Notice: Subject to any disclaimer, the term of this patent is extended or adjusted under 35 U.S.C. 154(b) by 101 days.

(21) Appl. No.: 16/456,597

(22) Filed: Jun. 28, 2019

(65) Prior Publication Data

US 2020/0100588 A1 Apr. 2, 2020

Related U.S. Application Data

(60) Provisional application No. 62/738,287, filed on Sep. 28, 2018.

(51) Int. Cl.

| | |
|---|---|
| ***A47B 87/02*** | (2006.01) |
| ***A47B 47/04*** | (2006.01) |
| ***A47B 96/02*** | (2006.01) |

(52) U.S. Cl.

CPC ..... *A47B 87/0223* (2013.01); *A47B 47/045* (2013.01); *A47B 96/024* (2013.01)

(58) Field of Classification Search

CPC . A47B 87/0223; A47B 47/045; A47B 96/024; A47B 96/021; A47B 47/0083; A47B 2031/004; A47B 2230/0077; A47B 87/0207; A47B 87/0215; A47B 87/0246; A47B 96/066; A47B 47/047; A47B 57/265; A47F 5/10; F16B 12/26

USPC .... 211/153, 183, 188, 119.003, 126.12, 134, 211/186, 194, 187, 182; 108/106, 110, 108/186, 91, 147.13

See application file for complete search history.

(56) References Cited

U.S. PATENT DOCUMENTS

| | | | | | |
|---|---|---|---|---|---|
| 3,118,696 | A * | 1/1964 | Resare | B25B 23/0035 | 403/328 |
| 4,696,406 | A * | 9/1987 | Karashima | A47B 96/021 | 108/110 |
| 4,706,576 | A * | 11/1987 | James | A47B 57/545 | 108/106 |
| 4,744,612 | A * | 5/1988 | Winter | A47B 57/48 | 211/186 |
| 4,832,209 | A * | 5/1989 | Schafer | A47B 96/021 | 211/153 |
| 4,981,224 | A * | 1/1991 | Rushing | A47B 87/0223 | 211/126.12 |
| 4,997,094 | A * | 3/1991 | Spamer | A47F 1/12 | 211/153 |
| 5,158,187 | A * | 10/1992 | Taub | A47B 87/0223 | 108/185 |

(Continued)

*Primary Examiner* — Hiwot E Tefera

(74) *Attorney, Agent, or Firm* — Jacob M. Ward; Ward Law Office LLC

(57) ABSTRACT

A modular shelf assembly that is adapted to interlock with adjacent modular shelf assemblies. The modular shelf assembly may include a shelf unit, a plurality of supports, and a plurality of feet. The shelf units, supports, and feet, in combination, are adapted to create the modular shelf assembly. The shelf unit may also be modular and have a shelf body that includes a cap. Each cap may have interlocking apertures that are adapted to receive interlocking components, which are used to connect multiple shelf assemblies.

20 Claims, 9 Drawing Sheets

(56) References Cited

U.S. PATENT DOCUMENTS

| | | | | | |
|---|---|---|---|---|---|
| 5,237,890 | A * | 8/1993 | Gill | B66F 13/00 | 24/615 |
| 5,964,163 | A * | 10/1999 | Cohen | A47B 49/004 | 108/186 |
| 6,155,435 | A * | 12/2000 | Malik | A47B 57/26 | 108/64 |
| 9,084,484 | B2 * | 7/2015 | Vilkomirski | A47B 87/0223 | |
| 9,474,374 | B2 * | 10/2016 | Reinhart | A47B 87/0223 | |
| 9,717,330 | B2 | 8/2017 | Reinhart | | |
| 9,930,963 | B2 * | 4/2018 | Guizzardi | A47B 91/026 | |
| 10,124,479 | B2 | 11/2018 | Reinhart | | |
| 10,709,238 | B1 * | 7/2020 | Thompson | A47B 87/0223 | |
| 2004/0159622 | A1 * | 8/2004 | Craft | A47B 96/021 | 211/153 |
| 2008/0173219 | A1 * | 7/2008 | Yankello | A47B 87/0246 | 108/59 |
| 2010/0326937 | A1 * | 12/2010 | Lin | A47B 96/021 | 211/135 |
| 2017/0071334 | A1 * | 3/2017 | Sitton | A47B 87/008 | |
| 2017/0290428 | A1 | 10/2017 | Reinhart | | |

* cited by examiner

SHELF ASSEMBLY

CROSS-REFERENCE TO RELATED APPLICATIONS

This application claims the benefit of U.S. Provisional Application No. 62/738,287, filed on Sep. 28, 2018. The entire disclosures of the above applications are hereby incorporated herein by reference.

FIELD

The present disclosure relates generally to a shelf and, more particularly, to a modular shelf.

BACKGROUND

Modular shelving systems are known for storing and supporting items and products of all types. Typically, modular shelving systems contain several components that may be assembled to conform to a user's needs. These components are often shipped disassembled, and then re-assembled at the desired location. However, known modular shelving systems are often difficult to construct, and require additional tools to build the shelving system.

An adjustable modular shelf is desirable for building shelves to the required configurations and needs of the user. In particular, modular shelving allows the user to adjust the height or distance between the shelves to facilitate storage of items having different shapes and sizes. Moreover, because the user typically assembles the modular shelving system on site, it is preferred that the components be lightweight.

It would also be advantageous to join multiple modular shelving units together. Beneficially, the joined modular shelving units would allow the user to create a shelf assembly of any desired length and width.

Accordingly, there is a continuing need for a shelf assembly that is lightweight, easy to assemble, and configured to connect with multiple shelf assemblies.

SUMMARY

In concordance with the instant disclosure, there is a continuing need for a shelf assembly that is lightweight, easy to assemble, and configured to connect with multiple shelf assemblies, has been surprisingly discovered.

In one embodiment, a shelf unit has a shelf body, a first end, a second end, at least one connecting arm opening, and at least one node aperture. The shelf body also has at least one support opening that is configured to receive a support. The shelf unit has at least one cap with at least one connecting arm and at least one receiver. The at least one connecting arm is configured to be disposed in the at least one connecting arm opening formed in the shelf body. The at least one connecting arm also has at least one node that is configured to connect with the at least one node aperture. The at least one receiver adapted to secure the support.

In another embodiment, a shelf assembly has a shelf body with a first end, a second end, at least one connecting arm opening, and at least one node aperture. The shelf assembly also includes at least one cap, which has at least one connecting arm and at least one receiver. The at least one connecting arm is configured to be disposed in the at least one connecting arm opening formed in the shelf body. The at least one connecting arm has at least one node that is adapted to connect with the at least one node aperture. The shelf assembly includes a plurality of supports. The plurality of supports may be a first support and a second support. Each of the supports are configured to be disposed in the at least one support opening and the at least one receiver. Each support has a first end portion and a second end portion. The first end portion of the first support is adapted to connect with the second end portion of the second support. The shelf assembly also includes a plurality of feet that are configured to connect with the at least one receiver.

In a further embodiment, a kit for a shelf assembly has a shelf body having at least one connecting arm opening, at least one node aperture, and at least one support opening. The kit also includes at least one cap having at least one connecting arm and at least one receiver. The at least one connecting arm configured to be disposed in the at least one connecting arm opening. The at least one connecting arm has at least one node that is adapted to connect with the at least one node aperture. The kit also has a plurality of supports. The plurality of supports include a first support and a second support. Each of the supports are configured to be disposed in the at least one support opening and the at least one receiver. Each support has a first end portion and a second end portion, where the first end portion of the first support is adapted to connect with the second end portion of the second support. The kit contains a plurality of feet that are configured to connect with the at least one receiver of the at least one cap.

Further areas of applicability will become apparent from the description provided herein. It should be understood that the description and specific examples are intended for purposes of illustration only and are not intended to limit the scope of the present disclosure.

DESCRIPTION OF THE DRAWINGS

The above, as well as other advantages of the present disclosure, will become readily apparent to those skilled in the art from the following detailed description, particularly when considered in the light of the drawings described hereafter.

DETAILED DESCRIPTION

Figure 1:
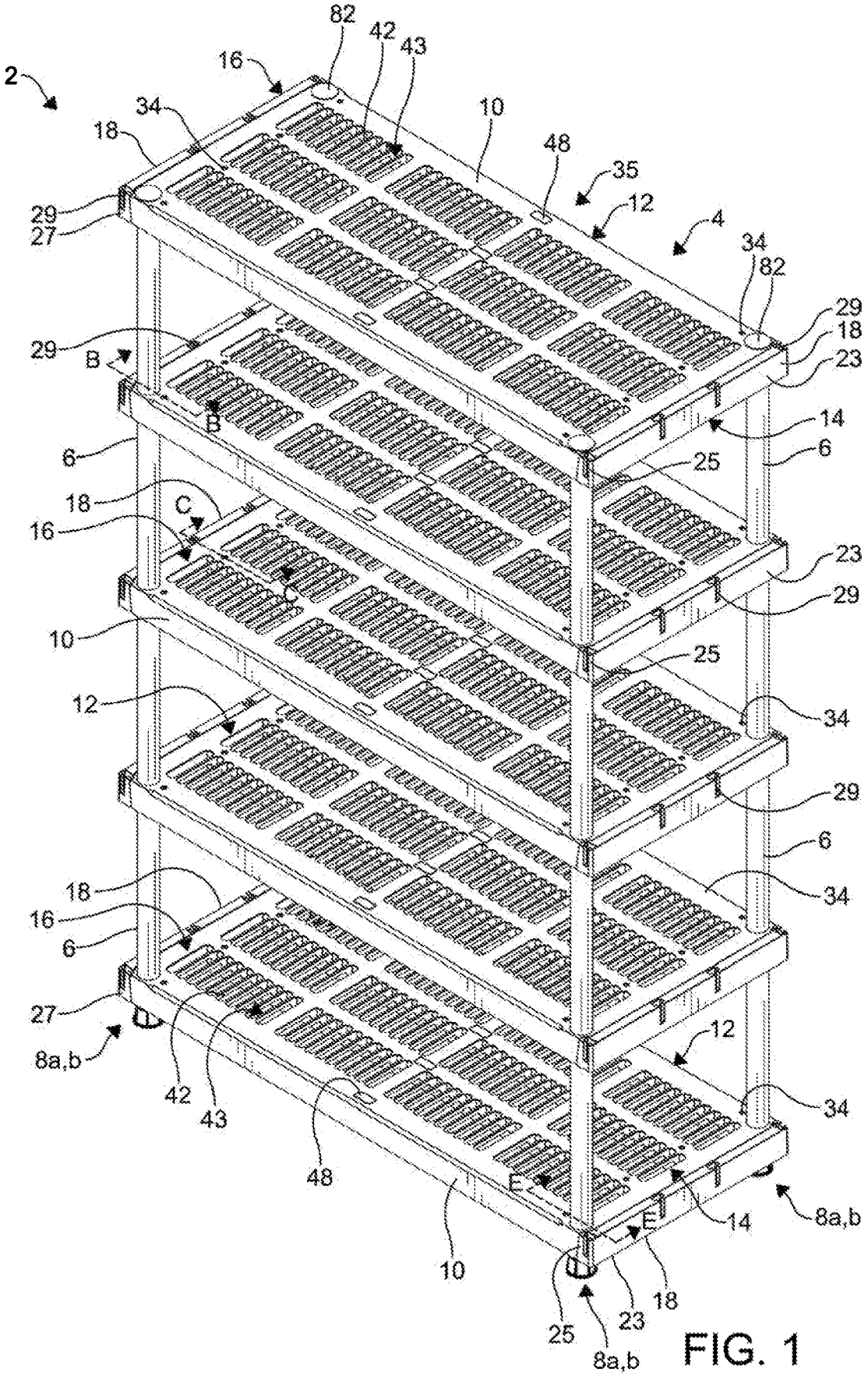
FIG. 1 is a top perspective view of a shelf assembly according to one embodiment of the present disclosure.

The following description is merely exemplary in nature and is not intended to limit the present disclosure, application, or uses. It should also be understood that throughout the drawings, corresponding reference numerals indicate like or corresponding parts and features.

FIGS. 1-14 show a modular shelf assembly 2 that is adapted to interlock with adjacent modular shelf assemblies 2. In certain embodiments, the modular shelf assembly 2 may include at least one shelf unit 4, a plurality of supports 6, and a plurality of feet 8*a*, 8*b*. The shelf units 4, supports 6, and feet 8, in combination, are adapted to create the modular shelf assembly 2.

In a non-limiting example, the shelf assembly 2 may be formed from a lightweight plastic material such as a polypropylene plastic material, by a molding process such as injection molding. However, it should be understood that the shelf assembly 2 may be formed from any suitable material, including other thermoplastic materials such as polyethylene, and non-thermoplastic materials such as foam or metal. Nonetheless, any suitable processes for forming the shelf assembly 2 may be chosen by one skilled in the art, as desired.

With reference to FIGS. 1-4, 6 and 11, and in particular embodiments, each shelf unit 4 may include a shelf body 10, a platform 12, a first end 14, a second end 16, and at least one cap 18. The at least one cap 18 may include a first cap 18 and a second cap 18. The first cap 18 may be adapted to connect with the first end 14 of the shelf body 10, and the second cap 18 may be adapted to connect with the second end 16 of the shelf body 10, thereby creating the shelf unit.

In a non-limiting example, with continued reference to FIGS. 1-4, 6, and 11, the shelf unit 4 may be substantially rectangular and have four corners. However, other shapes for the shelf unit 4 may also be selected by a skilled artisan, within the scope of the present disclosure.

Figure 2:
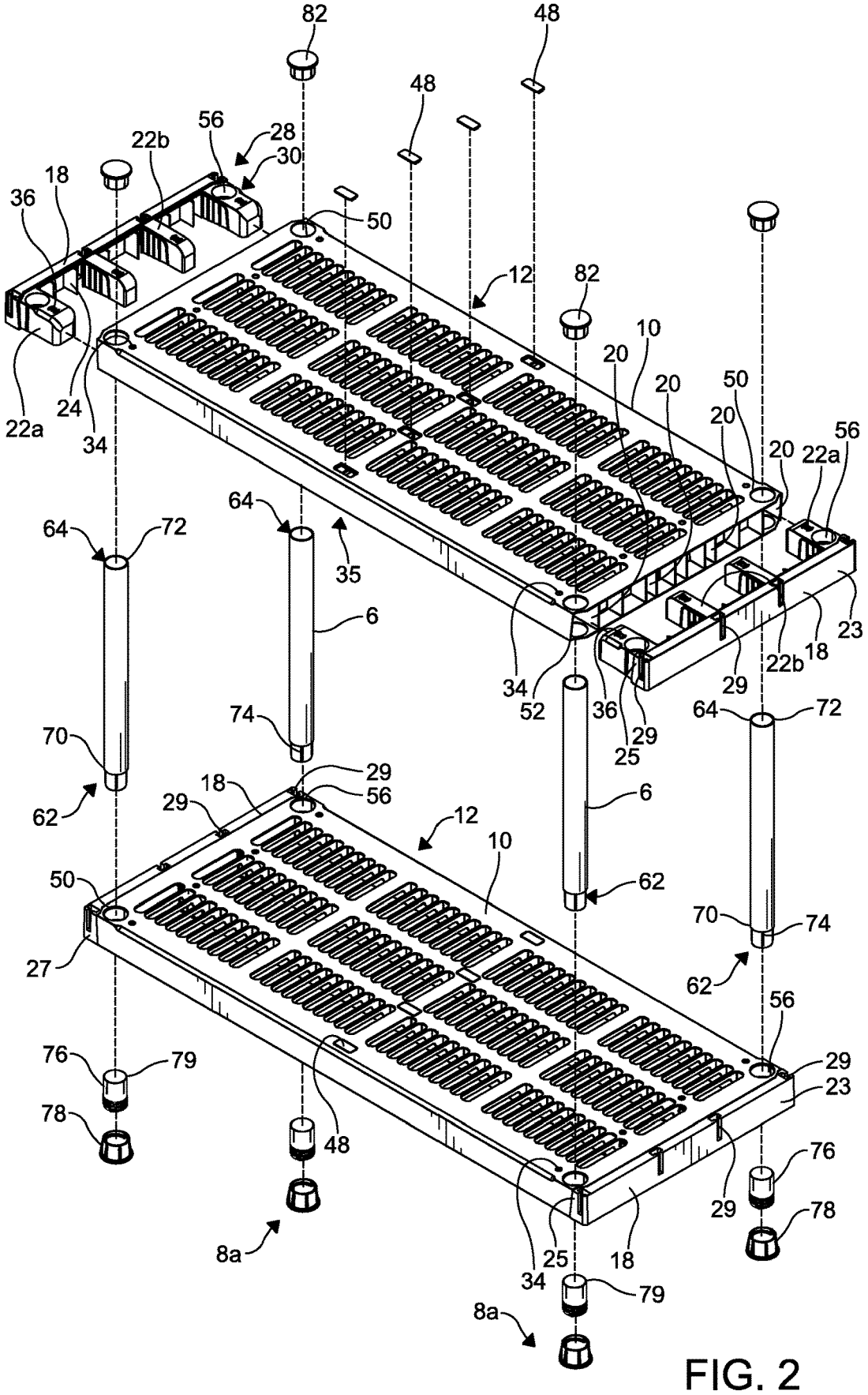
FIG. 2 is an exploded top perspective view of the shelf assembly according to another embodiment of the present disclosure.
Figure 3:
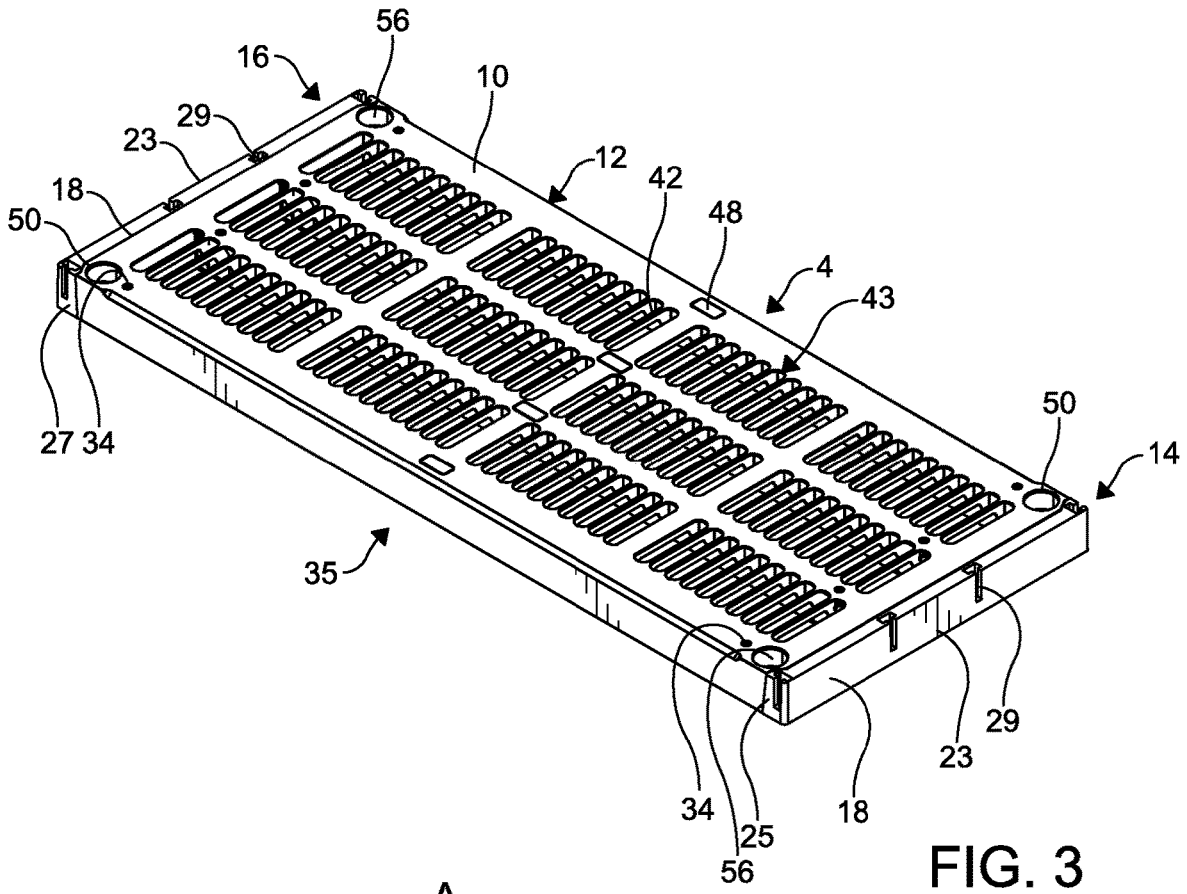
FIG. 3 is top perspective view of a shelf unit according to one embodiment of the present disclosure.
Figure 6:
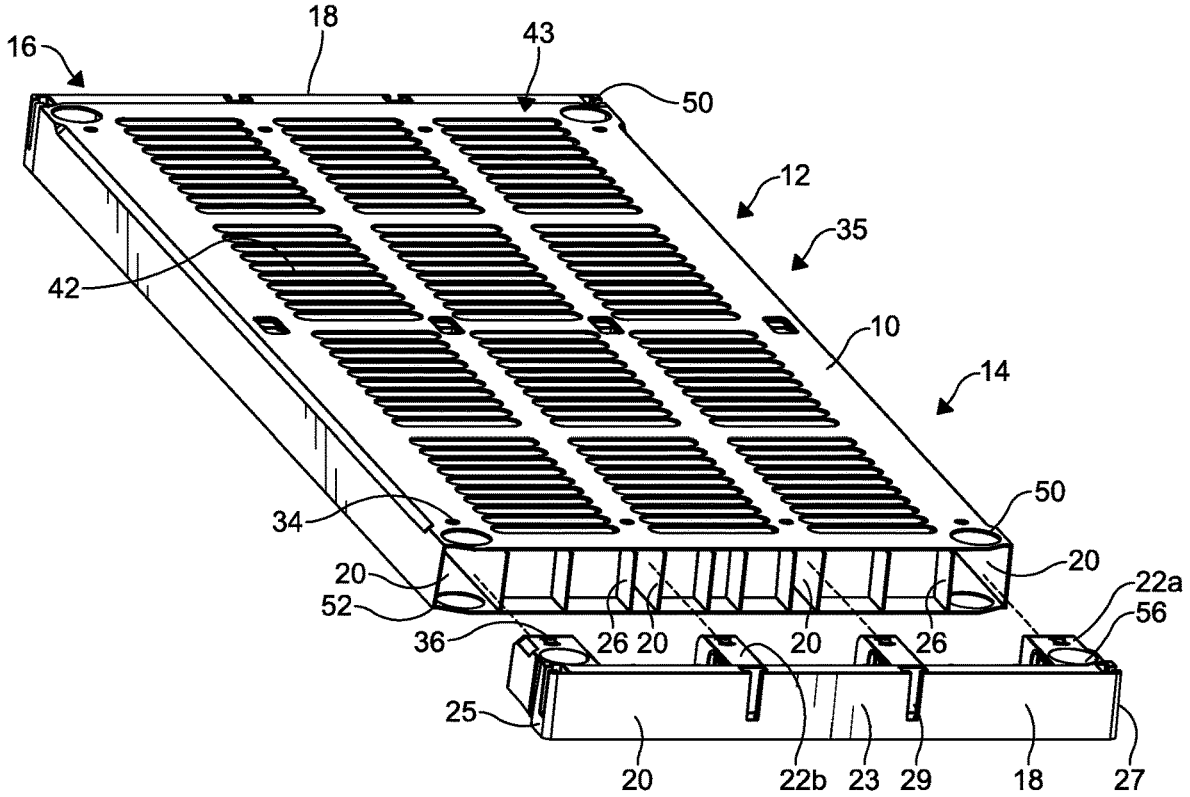
FIG. 6 is a partially exploded front perspective view of the shelf unit shown in FIG. 3.

With reference to FIGS. 2 and 6, in certain embodiments, the shelf body 10 may have a mostly hollow interior that includes connecting arm openings 20 formed in the first end 14 and the second end 16 of the shelf body 10. The connecting arm openings 20 formed in the first end 14 and the second end 16 of the shelf body 10 may be adapted to receive a plurality of connecting arms 22*a*, 22*b* disposed on each of the first cap 18 and the second cap 18. As a non-limiting example, the plurality of connecting arms 22*a*, 22*b* may include outer connecting arms 22*a* and inner connecting arms 22*b*. In a further non-limiting example, there may be a pair of outer connecting arms 22*a* and a pair of inner connecting arms 22*b*. However, it should be appreciated that any number of connecting arms 22*a*, 22*b* may be chosen by one skilled in the art, as desired.

Figure 7:
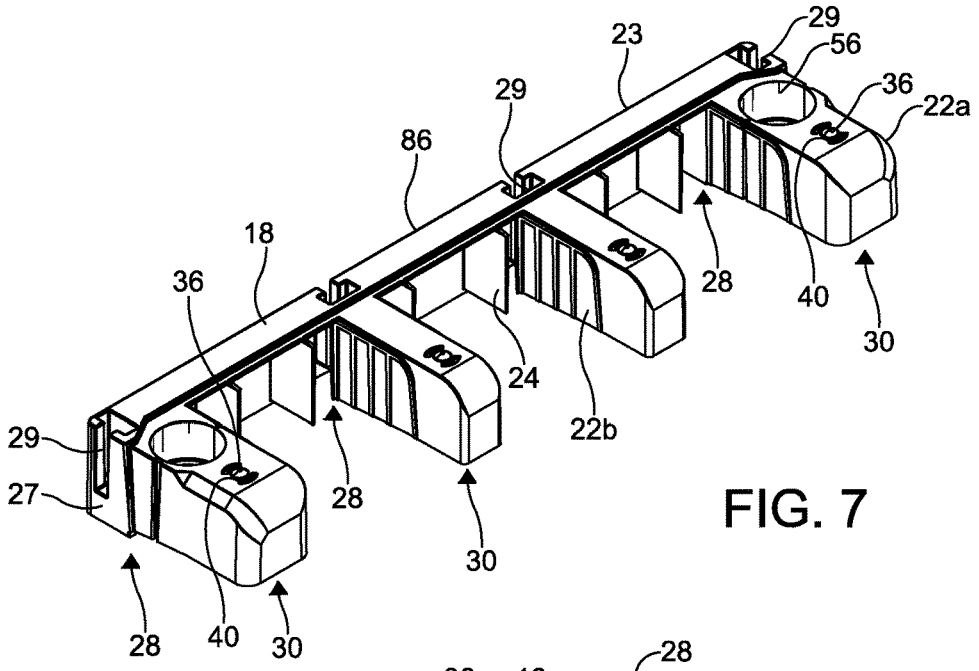
FIG. 7 is a top perspective view of a cap of the shelf unit shown in FIG. 3, depicting receivers, connecting arms, and nodes disposed thereon.

With reference to FIGS. 2 and 7, in particular embodiments, each cap 18 may have at least one tab 24 in between each connecting arm 22*a*, 22*b*. As shown in FIGS. 2 and 6, each end 14, 16 of the shelf body 10 may have at least one rib 26 between each connecting arm opening 20. In certain embodiments, the at least one tab 24 may be a plurality of tabs 24, and the at least one rib 26 may be a plurality of ribs 26. Each tab 24 is adapted to be disposed adjacent to each rib 26, where each cap 18 is connected with each end 14, 16 of the shelf body 10. It should be appreciated that the tabs 24 and the ribs 26 add a structural rigidity to the ends 14, 16 of the shelf unit, thereby militating against a disconnection of the cap 18 from the shelf body 10.

In a further embodiment, with reference to FIGS. 1-4, 6-8 and 11, each cap 18 may have an outer wall 23, a first side wall 25 and a second side wall 27. In certain embodiments, each cap 18 may have a plurality of interlocking apertures 29 formed on the outer wall 23, the first side wall 25, and the second side wall 27 of each cap 18. In a non-limiting example, there may be two interlocking apertures 29 formed in the outer wall 23, and a single interlocking aperture 29 formed in each side wall 25, 27. The interlocking apertures 29 may be configured to receive an interlocking component 31. The interlocking component 31 may have a symmetrical shape, which permits the interlocking component 31 to be received by different interlocking apertures 29 of the same shape.

Figure 11:
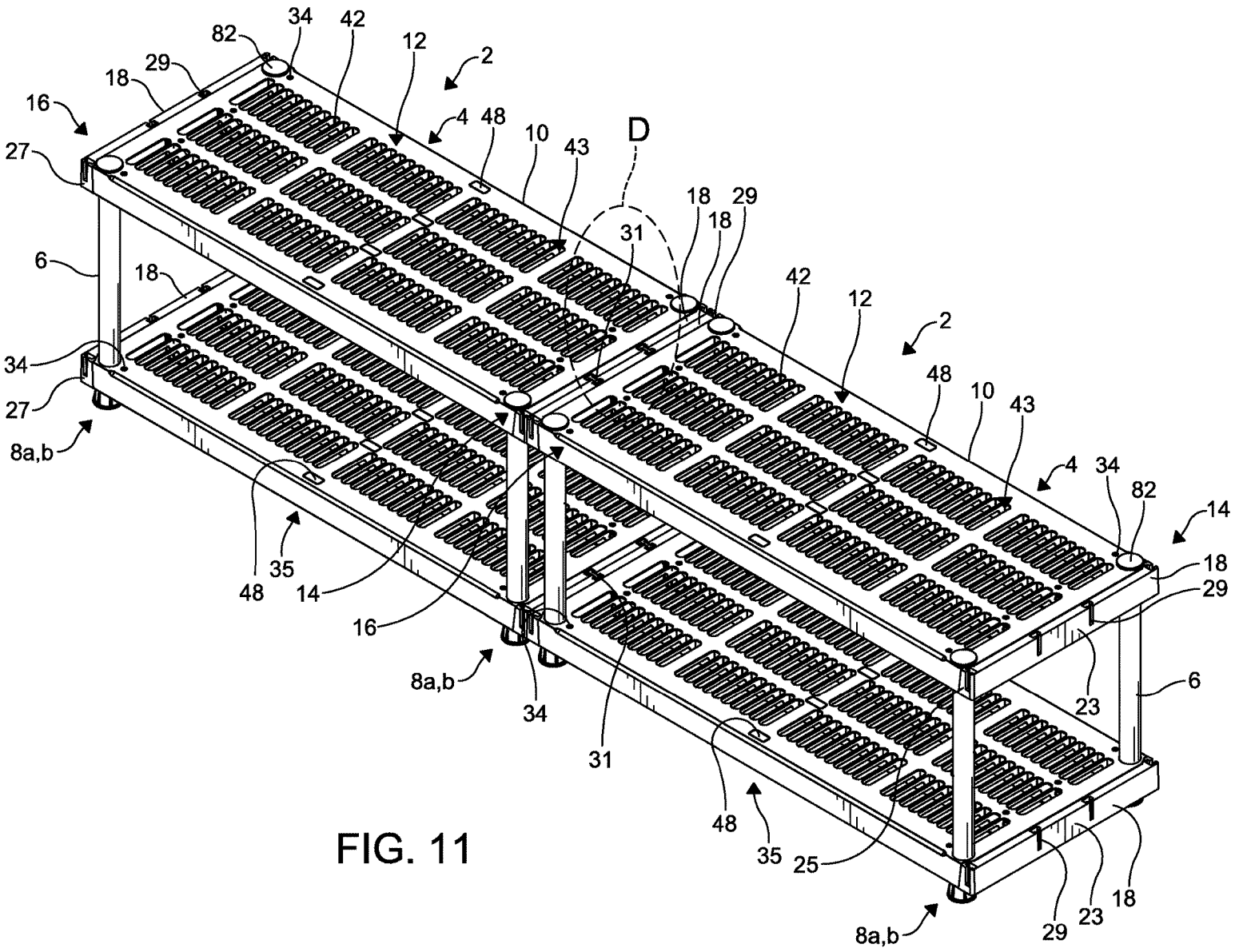
FIG. 11 is a top perspective, partially exploded view of two shelf assemblies joined by interlocking components.
Figure 12:
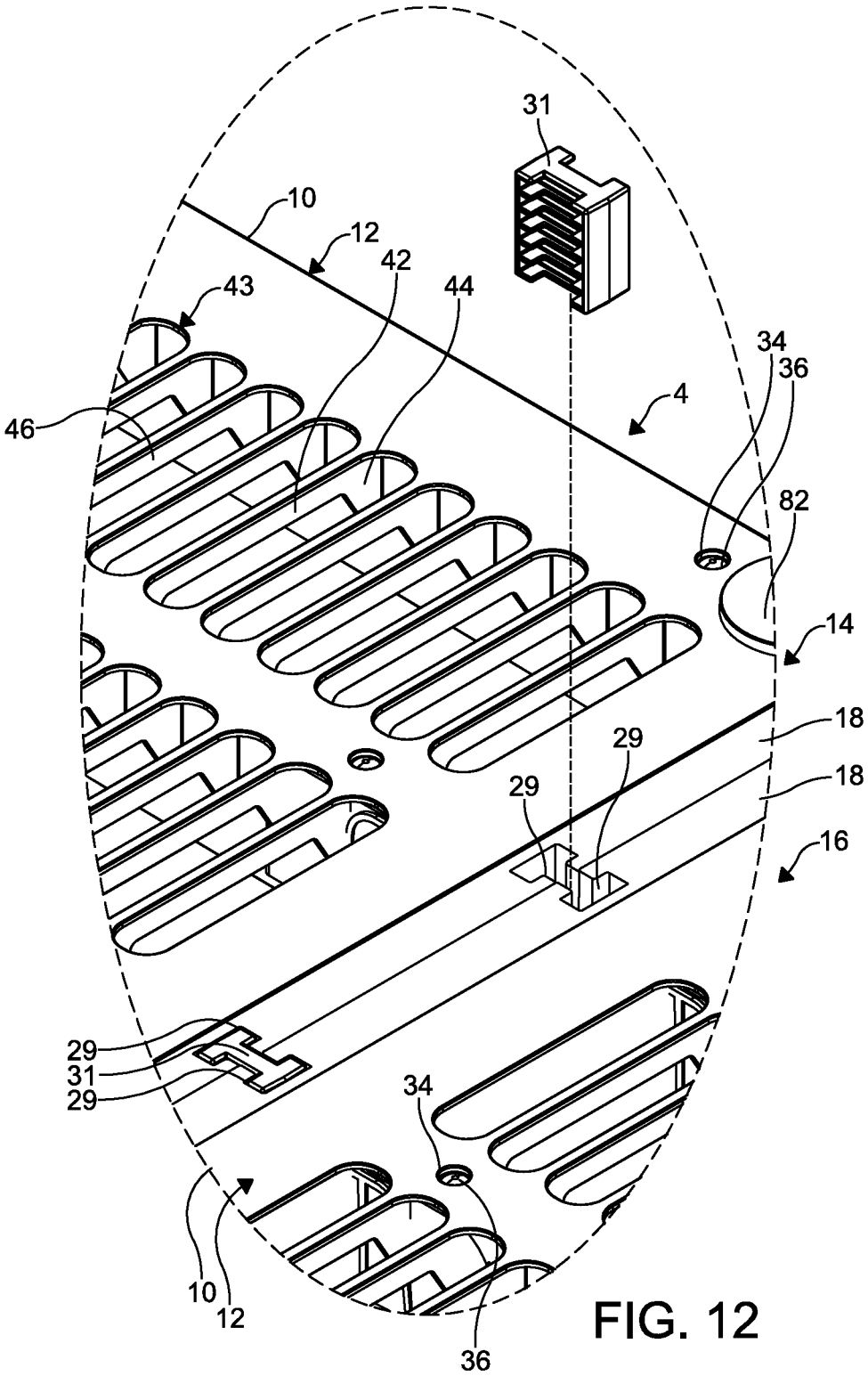
FIG. 12 is an enlarged, fragmentary, partially exploded, top perspective view taken at call-out D in FIG. 11, showing the interlocking component exploded from an interlocking aperture formed in a cap of each shelf assembly.

FIGS. 11-12 show the interlocking component 31 according to one embodiment of the present disclosure. In this embodiment, for example, as shown in FIG. 12, the interlocking component 31 is generally H-shaped. In a further embodiment, for example, the interlocking apertures 29 are generally T-shaped to receive a portion of the H-shaped interlocking component 31. In particular, a T-shaped portion of the at least one interlocking component 31 is configured to be received by the T-shaped interlocking aperture 29. However, one of ordinary skill in the art may select other suitable shapes for the interlocking aperture 29 and the interlocking component 31, as desired.

Advantageously, the interlocking apertures 29 and the interlocking component 31 are used to connect multiple shelf assemblies 2. For example, as shown in FIG. 12, a first connecting portion of the interlocking component 31 is disposed in each cap 18 a first shelf assembly 2, and a second connecting portion of the interlocking component 31 is disposed on the cap 18 of a second shelf assembly 2.

Figure 8:
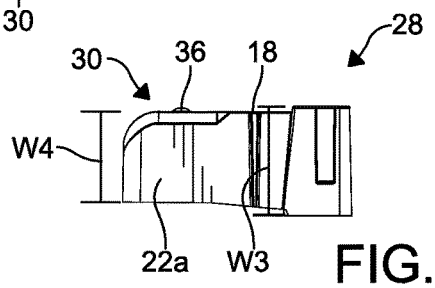
FIG. 8 is side elevational view of the cap shown in FIG. 7, depicting a width W3 of a proximal portion of the connecting arm and a width W4 of a distal portion of the connecting arm.

With reference to FIGS. 2, 7-8, the outer connecting arms 22*a* and the inner connection arms 22*b* may each have a proximal portion 28 and a distal portion 30. For example, the proximal portion 28 of the connecting arms 22*a*, 22*b* may be substantially rectangular in shape and adjacent to the outer wall 23 of the cap 18, while the distal portion 30 of the connecting arms 22*a*, 22*b* may be contoured. Advantageously, the contoured shape of the distal portion 30 facilitates a guiding of the connecting arms 22*a*, 22*b* into the connecting arm openings 20.

Figure 4:
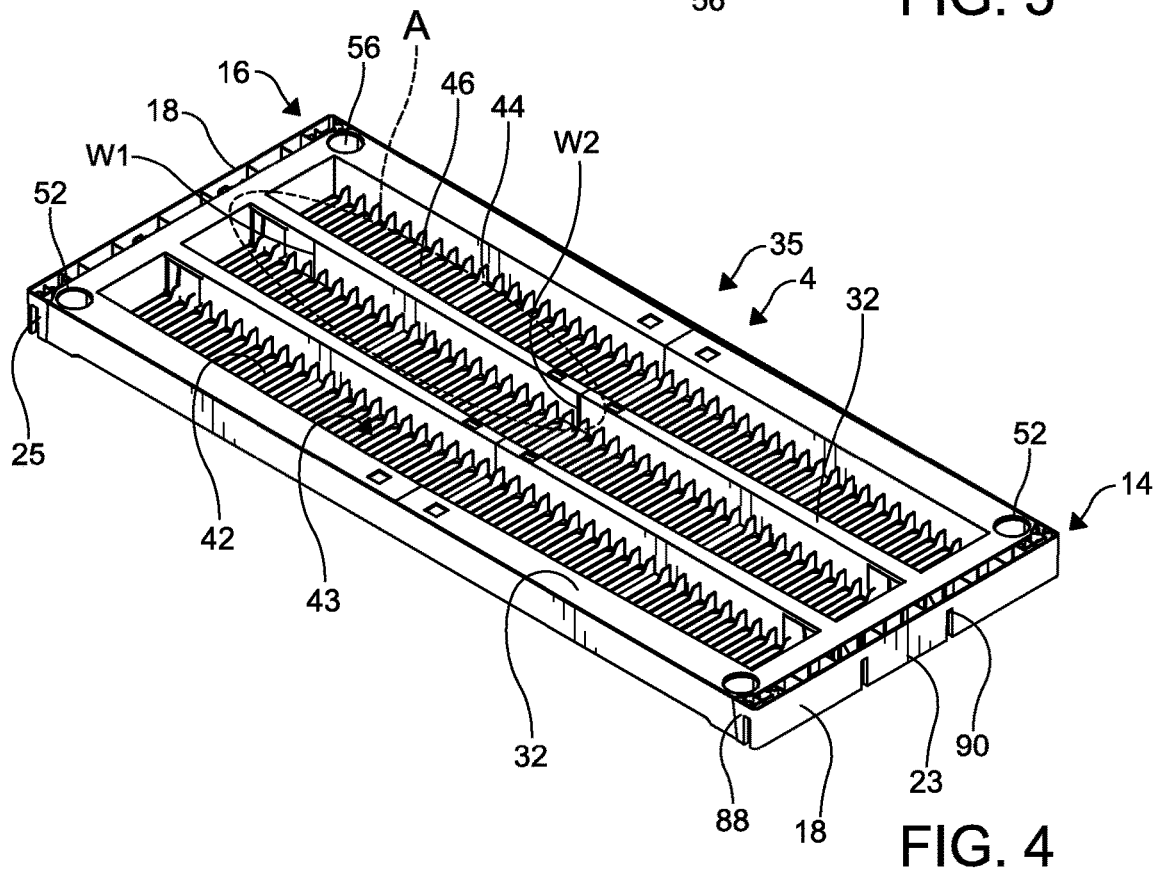
FIG. 4 is a bottom perspective view of the shelf unit shown in FIG. 3.
Figure 5:
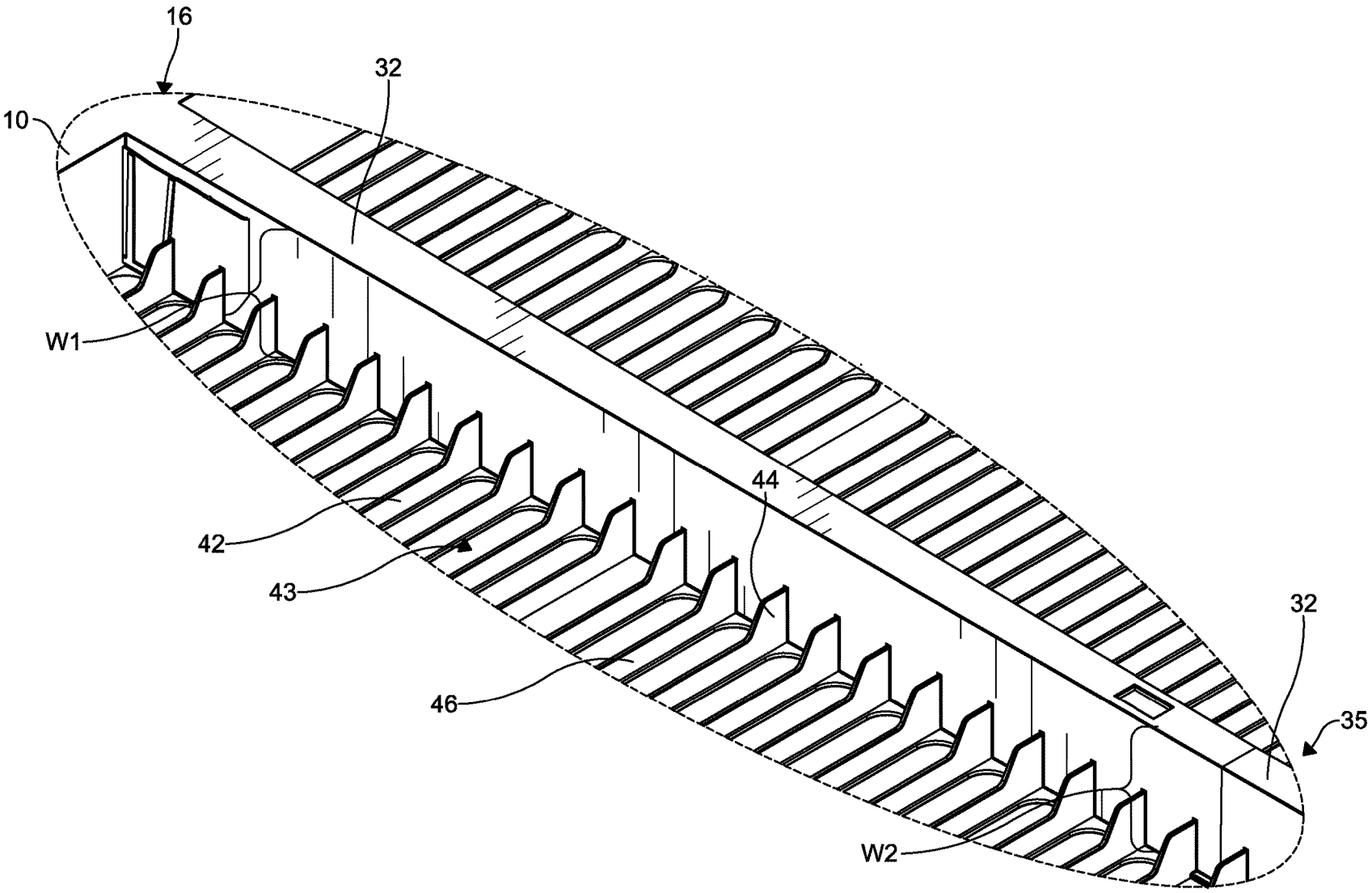
FIG. 5 is an enlarged, fragmentary top perspective view of the shelf unit taken at call-out A in FIG. 4, showing a width W1 of the crossbar adjacent to a second end of the shelf unit and a width W2 of the crossbar adjacent to a center of the shelf unit.

In particular embodiments, as shown in FIGS. 4-5, the platform 12 of the shelf body 10 may be supported by at least one crossbar 32. In certain embodiments, the at least one crossbar 32 may be a plurality of crossbars 32. For example, each crossbar 32 may be hollow and integrally molded in the shelf body 10 to support the platform 12. Additionally, in a further example, each crossbar 32 may be disposed, uninterrupted, between the first end 14 and the second end 16 of the shelf body 10. However, other dimensions and shapes of the crossbar 32 may be chosen by one skilled in the art, as desired.

With continued reference to FIGS. 4-5, advantageously, each crossbar 32 may be tapered toward a center 35 of the shelf body 10. The tapering of the crossbars 32 toward the center 35 of the shelf body 10 creates an arched crossbar 32 that is adapted to support and dissipate the weight of items placed on the shelf platform 12. The tapered, or arched, crossbars 32 advantageously distribute force outward from the center 35 of the shelf body 10 to the supports 6 and reduces the effects of tension on an underside of the platform 12. For example, each crossbar 32 may have a first width W1 adjacent to each end 14, 16 of the shelf body 10, and a second width W2 adjacent to the center 35 of the shelf body 10. The first width W1 adjacent to each end of the shelf body 10 may be larger than the second width W2 adjacent to the center 35 of the shelf body 10, thereby creating the tapered, arched, crossbar 32, as shown in FIG. 5, which advantageously allows the shelf unit 4 to support a greater amount of weight.

In further embodiments, as shown in FIGS. 5 and 6, where the hollow crossbars 32 connect with the first end 14 and the second end 16 of the shelf body 10, the hollow crossbars 32 may define the connecting arm openings 20. Accordingly, each connecting arm of each cap 18 may be adapted to be disposed within the hollow crossbars 32 as well as the connecting arm openings 20. To facilitate a fitting within the hollow crossbars 32, the connecting arms 22*a*, 22*b* may also be tapered. For example, as shown in FIG. 8, the proximal portion 28 of the connecting arms 22*a*, 22*b* may have a proximal width W3 and the distal portion 30 of the connecting arms 22*a*, 22*b* may have a distal width W4. The distal width W4 may be less than the proximal width W3, facilitating a fitting of the connecting arms 22*a*, 22*b* into the hollow crossbars 32. However, it should be appreciated that alternate dimensions for the hollow crossbars 32 and the connecting arms 22*a*, 22*b* may be chosen by one skilled in the art, as desired.

With reference to FIGS. 1-3, 6, 9-10, and 11-14, in particular embodiments, formed in the shelf body 10 adjacent to the first end 14 and the second end 16 may be a plurality of node apertures 34. These node apertures 34 may be configured to receive nodes 36 that are disposed on the connecting arms 22*a*, 22*b* of the first cap 18 and the second cap 18. For example, the nodes 36 may be formed in a top surface of the connecting arms 22*a*, 22*b* and may be disposed on the distal portion 30 of the connecting arms 22*a*, 22*b*. The connecting arms 22*a*, 22*b* may have at least one opening 40 adjacent to the node 36, which facilitates a movement of the node 36. In a non-limiting example, there may be two openings 40 adjacent to each node. As shown in FIGS. 9-10, and 13-14, the flexing of the node 36 facilitates a coupling of the node 36 with the node aperture 34, forming an interference fit that allows each cap 18 to be removably connected to each end 14, 16. It should be appreciated that the number of node apertures 34 may be dependent upon the number of nodes 36 disposed on the connecting arms 22*a*, 22*b* formed in each cap 18. Although four node apertures 34 are illustrated adjacent to each of the first side 14 and the second side 16 of the shelf body 10, any number of node apertures 34 are contemplated for use, depending on the overall shape of the shelf body 10 selected.

With reference to FIGS. 1-6 and 11-12, in particular embodiments, the shelf platform 12 may have a plurality of strips 42, where each strip 42 is spaced apart from an opposing strip 42, forming a gap 43 therebetween. Advantageously, each strip 42 separated from the opposing strip 42 by the gap 43 creates a lighter shelf unit. It should be appreciated that the lighter shelf unit 4 enables the supports 6 of the shelf assembly 2 to carry more weight on the shelves, due to the weight reduction created by the gaps 43. Additionally, it should be understood that the gaps 43 formed between each strip 42 formed in the platform 12 of the shelf body 10 save on manufacturing costs for the shelf assembly 2.

In a non-limiting example, as shown in FIGS. 5 and 12, each strip 42 may have an outer portion 44 and a middle portion 46. For example, the outer portions 44 of each strip 42 may be connected to crossbars 32 and the middle portion 46 of each strip 42 may be disposed between the crossbars 32. In certain embodiments the outer portion 44 of the strips 42 may be wider than the middle portion 46 of the strips 42, forming an arched strip 42, which advantageously distributes weight efficiently to the crossbars 32, while reducing the effects of tension on the underside of the platform 12. However other dimensions or shapes of the strips 42 may be chosen by one skilled in the art, as desired.

In further embodiments, as shown in FIGS. 1-3 and 11, the shelf body 10 may also have indicators 48 disposed on the platform 12. It should be appreciated that the indicators 48 enable a user to properly orient the shelf unit 4 while constructing the shelf assembly 2, facilitating a more efficient construction of the shelf assembly 2.

With reference to FIGS. 1-3, 6, 9-10, and 13-14, the platform 12 of the shelf body 10 may have upper support openings 50 formed therein. The upper support openings 50 are adapted to receive the supports 6. For example, the upper support openings 50 may be disposed in the platform 12 adjacent to the first end 14 or second end 16 of the shelf body 10. In a further non-limiting example, the upper support openings 50 may each be disposed in a corner of the shelf assembly 2. However, it should be appreciated that any number, or location, of the upper support openings 50 may be chosen by one skilled in the art, depending on the overall shape of the shelf body 10 selected.

With reference to FIGS. 2, 4, 6, 9-10 and 13-14, to facilitate a stacking of supports 6 through the shelf unit 4, each shelf body 10 may have a lower support opening 52 formed therein. For example, each lower support opening 52 may be formed in the crossbars 32 adjacent to the first end 14 or the second end 16 of the shelf body 10. In a further non-limiting example, the lower support openings 52 may each be disposed in the corners of the shelf assembly 2. However, any number, or location, of lower support openings 52 may be chosen by one skilled in the art, depending on the overall shape of the shelf unit 4 selected.

Furthermore, in certain embodiments, each lower support opening 52 may be surrounded by a guiding protrusion 54. It should be appreciated that the guiding protrusion 54 directs the supports 6 into the lower support opening 52.

With reference to FIGS. 1-4, 6, 7, 9, and 13-14, the shelf unit 4 may have a receiver 56 disposed therein. For example, the receiver 56 may be formed in the outer connecting arms 22*a* of each cap 18. However, it should be appreciated that the receiver 56 may be formed in any location in the shelf unit 4, as desired. In certain embodiments, the upper support opening 50 formed in the platform 12, and the lower support opening 52 formed in the crossbar 32 may each be in a location and have dimensions that allow the support 6 to pass through the shelf body 10, enabling the receiver 56 to secure the support 6 therein.

With reference to FIGS. 7, 9, 13 and 14, in certain embodiments, the receiver 56 may have an inner surface that defines an opening, and the interior surface of the receiver 56 may have a ridge 58 disposed thereon. For example, the ridge 58 of the receiver 56 may be uninterrupted and traverse the inner surface. In further examples, the ridge 58 may be an equal distance from a bottom surface and the top surface of the outer connecting arm 22*a*. It should be appreciated that the ridge 58 disposed at an equal distance from the bottom surface and the top surface of the outer connecting arm 22*a* provides an equal amount of interior surface area above and below the ridge 58, which militates against a disconnection of the supports 6 within the receiver 56.

With renewed reference to FIGS. 1-4, 6 and 11 in an exemplary embodiment, where the shelf unit 4 is rectangular in shape, the upper support openings 50, the lower surface openings 52, and the receivers 56 may each be disposed in the corners of the shelf body 10. It should be appreciated that the supports 6 being secured at the corners of the shelf unit 4 increases the stability of the shelf unit 4 by militating against an undesirable falling of the shelf assembly 2.

With reference to FIGS. 1-2, and 11, each shelf unit 4 may be secured to another shelf unit 4 by the supports 6. For example, each support 6 may have a first end portion 62 and a second end portion 64. In certain embodiments, the plurality of supports 6 may include a first support 6 and a second support 6. The first end portion 62 of the first support 6 may be configured to connect with the second end portion 16 of the second support 6. For example, the first end portion 62 of the first support 6 may be adapted to fit within the second end portion 64 of the second support 6, which facilitates a stacking of multiple supports 6. However, it should be appreciated that the first support 6 may be connected to the second support 6 by any mechanism as chosen by one skilled in the art.

Figure 9:
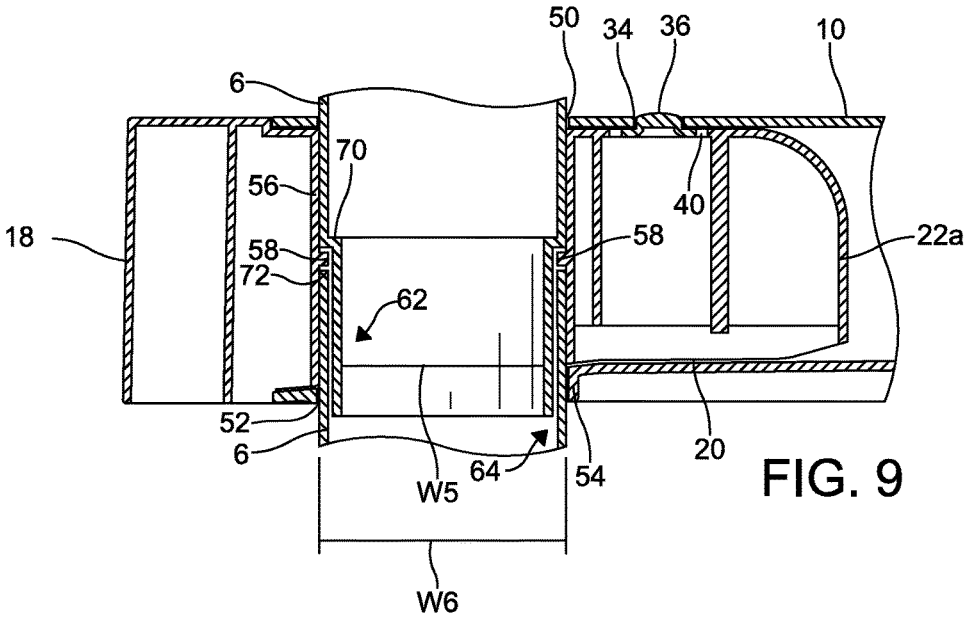
FIG. 9 is an enlarged, fragmentary, cross-sectional, side elevational view taken at cross-section B-B in FIG. 1, showing an outer connecting arm disposed in a connecting arm opening, with a first support and a second support disposed within the receiver, and the node disposed within the node aperture.
Figure 10:
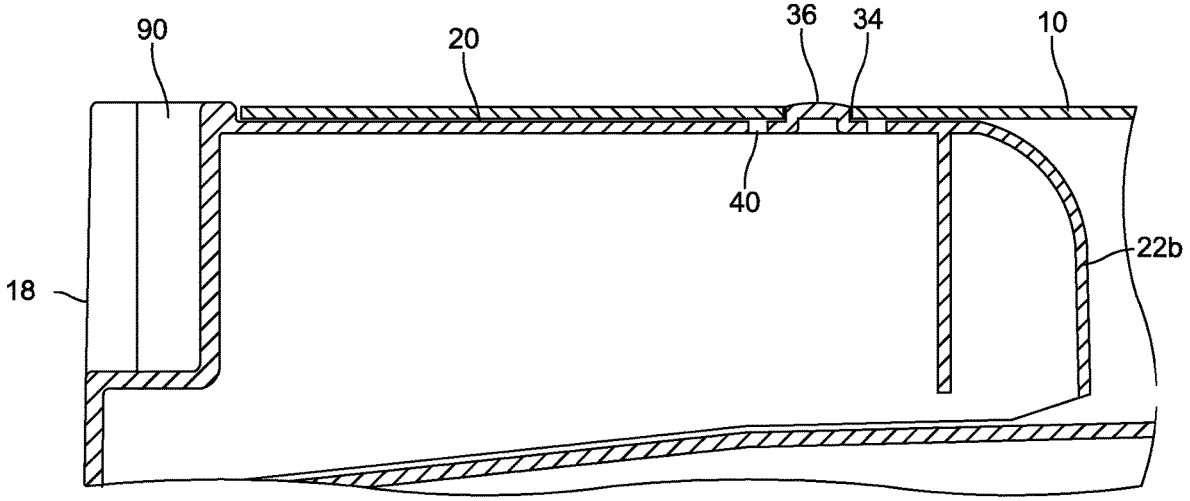
FIG. 10 is an enlarged, fragmentary, cross-sectional, side elevational view taken at cross-section C-C in FIG. 1, showing an inner connecting arm disposed in the connecting arm opening and the node disposed in the node aperture.

In a particular embodiment, for example, as shown in FIG. 9, the first end portion 62 of the first support 6 may have a first end portion 62 and width W5, and the second end portion 64 of the second support 6 may have a second end portion 64 and width W6. The first end portion 62 with the width W5 may be less than the second end portion 64 with the width W6, facilitating a fitting of the first end portion 62 into the second end portion 64. Nonetheless, other dimensions for each support 6 may be chosen by one skilled in the art within the scope of the present disclosure, as desired.

Advantageously, the stackable supports 6 allow the user to adjust the height of the shelf assembly 2 by choosing a desired number of supports 6 and shelf units 4 to be constructed. It should also be appreciated that the first end portion 62 of the first support 6 fitting into the second end portion 64 of the second support 6 provides stability to each support 6 where the supports 6 are stacked.

With reference to FIGS. 2, 9, and 13-14, each support 6 may have a ledge 70 adjacent to the first end portion 62, and an outer edge 72 adjacent to the second end portion 64. The ledge 70 adjacent to the first end portion 62 of the first support 6 is configured to abut the outer edge 72 of the second end portion 64 of the second support 6, where the first end portion 62 is inserted into the second end portion 64. Similarly, the ledge 70 adjacent to the first end portion 62, and the outer edge 72 of the second end portion 64 may each be adapted to abut the ridge 58 within the receiver 56.

In a further embodiment, the first end portion 62 of each support 6 may have a plurality of projections 74 on an outer surface thereof. The plurality of projections 74 increases friction between the first end portion 62 and the second end portion 64 of the supports 6 where the first end portion 62 of the first support 6 is disposed within the second end portion 64 of the second support 6. The increased friction creates a tighter, more efficient interference fit between the supports 6 where stacked.

With reference to FIGS. 1-2, 11, and 13-14, in certain embodiments, the shelf assembly 2 may include the plurality of feet 8*a*, 8*b* that are adapted to reinforce the shelf assembly 2 where constructed.

Figure 13:
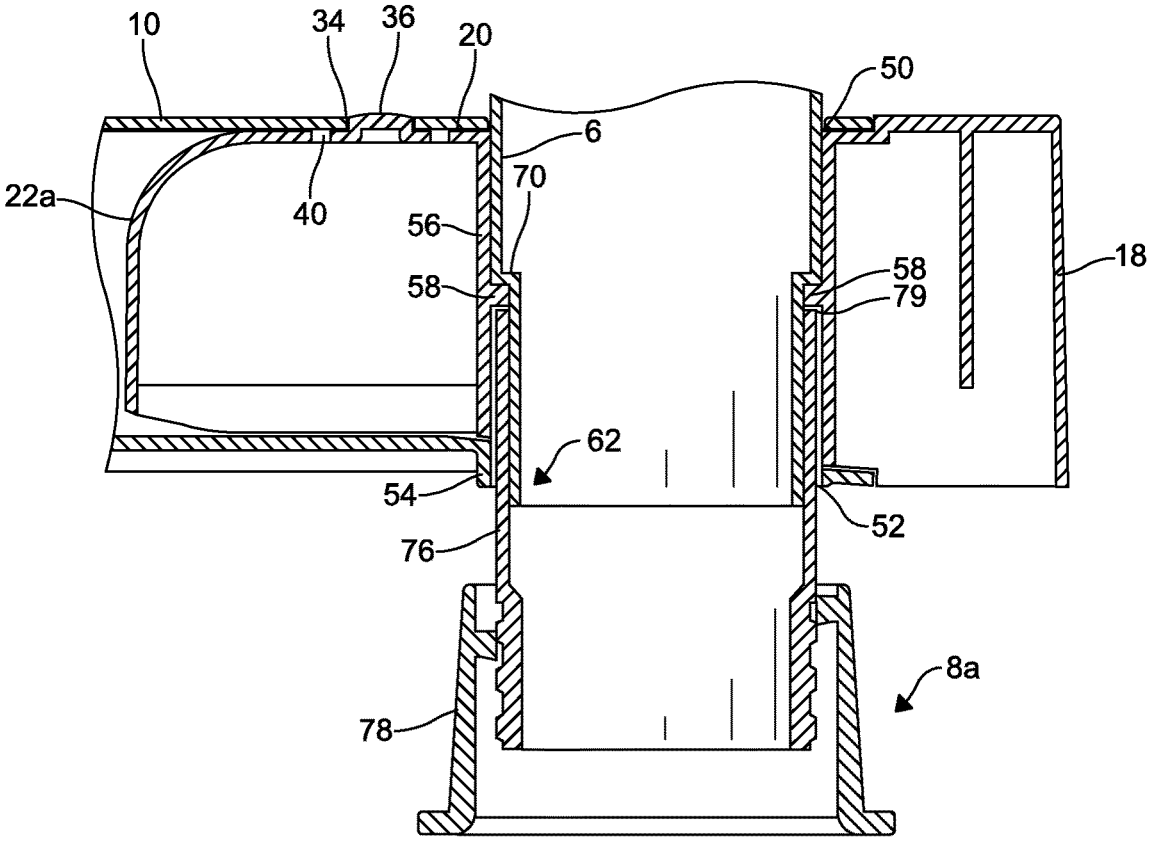
FIG. 13 is an enlarged, fragmentary, cross-sectional view, taken at cross-section E-E in FIG. 1, depicting an adjustable foot according to one embodiment of the present disclosure.

In certain embodiments, as shown in FIGS. 2 and 13 an adjustable foot 8*a* may be used to support the shelf assembly 2. The adjustable foot 8*a* may have an insert portion 76 that is configured to be disposed within the receiver 56 and an adjusting portion 78, which is configured to alter the height of the shelf assembly 2. The insert portion 76 may be adapted to surround the first end portion 62 of each support. The insert portion 76 may also have a top edge 79 that is configured to abut the ridge 58 within the receiver 56. For example, the insert portion 76 of the foot 8*a* may have threading on an exterior surface, and the adjusting portion 78 may have threading on an interior surface, whereby the height of the foot 8*a* is adjusted by rotating the adjusting portion 78 clockwise or counter clockwise. For example, the adjusting portion 78 may lower the height of the foot 8*a* by being rotated clockwise and raise the height of the foot 8*a* by being rotated counter-clockwise. However, it should be appreciated that other types of adjustable feet 8*a* may be chosen by one skilled in the art, as desired.

Figure 14:
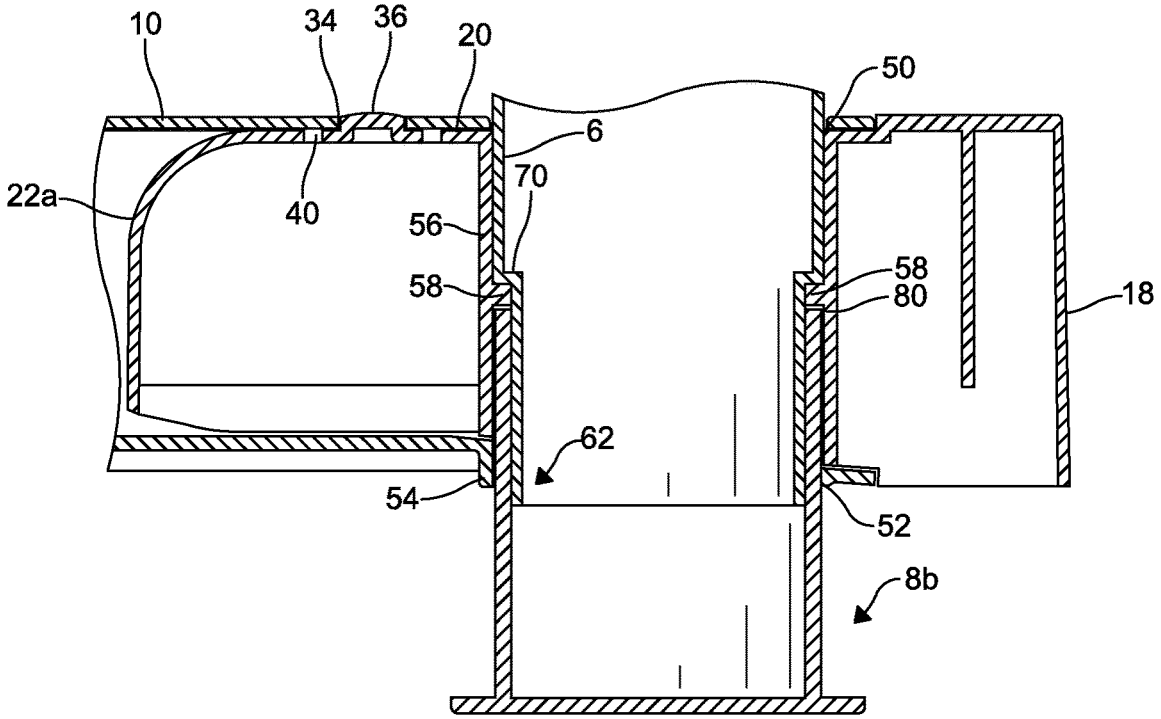
FIG. 14 is an enlarged, fragmentary, cross-sectional view, taken at cross-section E-E in FIG. 1, depicting a fixed foot according to another embodiment of the present disclosure.

In a further embodiment, as shown in FIG. 14 a fixed foot 8*b* may be used to support the shelf assembly 2. The fixed foot 8*b* may be adapted to fit within the receiver 56 and surround the first end portion 62 of the support 6. An upper rim 80 of the fixed foot 8*b* may be adapted to abut the ridge 58 in the receiver 56.

With reference to FIGS. 1-2, and 11-12, the shelf assembly 2 may further include covers 82. The covers 82 are adapted to be disposed through the upper support opening 50 and connect with the receivers 56. It should be appreciated that the covers 82 militate against items falling into the receivers 56 and supports 6 of the shelf assembly 2.

With reference to FIGS. 1-2, 6 and 11, in operation, to construct the shelf assembly 2, the shelf units 4 are assembled by inserting the connecting arms 22*a*, 22*b* of the first cap 18 into the connecting arm openings 20 in the first end 14 of the shelf body 10. The connecting arms 22*a*, 22*b* of the second cap 18 are then inserted into the connecting arm openings 20 in the second end 16 of the shelf body 10. Each cap 18 is pressed into each side of the shelf body 10 until the nodes 36 on the connecting arms 22*a*, 22*b* form an interference fit with the node apertures 34 formed in the platform 12. It should be appreciated that a skilled artisan may construct as many shelf units 4, as is desired, for the shelf assembly 2.

With renewed reference to FIGS. 1-2, and 11, after the desired number of shelf units 4 has been created, the shelf units 4 may be connected to each other by the plurality of supports 6. For example, the first end portion 62 of the first support 6 may be inserted through the upper support opening 50 in the platform 12, until the ledge 70 of the first support 6 abuts the ridge 58 within the receiver 56. In a further example, the second end portion 64 of the second support 6 may then be inserted through the lower support opening 52, until the outer edge 72 of the second end portion 64 of the second support 6 abuts the ridge 58 within the receiver 56. The second end portion 64 of the second support 6 surrounds the first end portion 62 of the first support 6 within the receiver 56, adding to the stability of the shelf. However, a skilled artisan may insert the supports 6 into the shelf unit 4 in any orientation, as desired.

Additionally, it should be appreciated that the number of supports 6 inserted into the shelf assembly 2 depends on the number of receivers 56. For example, each receiver 56 may secure a pair of supports 6. After each shelf unit 4 is connected to an opposing shelf unit 4 by supports 6, in a further example, receivers 56 formed in a bottom most shelf unit 4 may secure the first end portion 62 or the second end portion 64 of each support 6 as well as the feet 8*a*, 8*b*. In a non-limiting example, as shown in FIG. 13, the insert portion 76 of the adjustable foot 8*a* may be inserted until the top edge 79 of the adjustable foot 8*a* abuts the ridge 58 within the receiver 56, and the insert portion 76 surrounds the first end portion 62 of each support 6. However, it should be appreciated that one skilled in the art may select the fixed foot 8*b* to support the shelf assembly 2, as desired. Once the feet 8*a*, 8*b* have been secured in the receivers 56 of the bottom most shelf unit 4, the receivers 56 of a top most shelf unit 4 may secure the first end portion 62 or the second end portion 64 of each support 6, as well as the covers 82.

In a particular embodiment, as shown in FIGS. 11-12, multiple shelf assemblies 2 may be connected to each other by inserting the interlocking components 31 into the interlocking apertures 29 formed in the caps 18 of adjacent shelf assemblies 2. For example, in operation, as shown in FIG. 12, the first connecting portion of the interlocking component 31 is disposed in the interlocking aperture 29 formed in the first cap 18 of the first shelf assembly 2, and the second connecting portion of the interlocking component 31 is disposed the interlocking aperture 29 formed in the second cap 18 of a second shelf assemblies 2.

It should be understood that the interlocking components 31 and interlocking apertures 29 enable the user to interlock the caps 18 of multiple shelf assemblies 2, enabling the user to extend the length and width of their shelf assembly 2, as desired.

Additionally, in various embodiments, the shelf unit 4, the supports 6, the feet 8*a*, 8*b*, the covers 82, and the interlocking components 31 may be sold separately as a kit. The kit enables the user to construct shelf assemblies 2 of varying heights and widths, as desired.

Advantageously, the shelf assembly 2 is lightweight, easy to assemble, and configured to interlock with multiple shelf assemblies 2.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A shelf unit for a shelf assembly, comprising:

a shelf body having a first end, a second end, at least one connecting arm opening, at least one node aperture, and at least one support opening that is configured to receive a support; and at least one cap having at least one connecting arm and at least one receiver, the at least one connecting arm configured to disposed in the at least one connecting arm opening, the at least one connecting arm having at least one flexible node that is configured to connect with the at least one node aperture forming an interference fit that allows the at least one cap to be removably connected to one of the first end and the second end of the shelf body, the flexible node having an edgeless uppermost surface that is disposed within the node aperture when connected therewith and accessible from an exterior of the shelf body so that the flexible node can be displaced from the node aperture and the at least one cap can be removed from the one of the first end and the second end of the shelf body, and the at least one receiver adapted to secure the support;

wherein the at least one connecting arm includes two openings adjacent the at least one flexible node, the flexible node disposed between the two openings, the openings facilitating a movement of the flexible node.

2. The shelf unit of claim 1, wherein the at least one connecting arm has a distal portion and a proximal portion, and the distal portion of the at least one connecting arm is contoured to facilitate an entry into the at least one connecting arm opening.

3. The shelf unit of claim 1, wherein the at least one connecting arm is a pair of outer connecting arms and a plurality of inner connecting arms.

4. The shelf unit of claim 3, wherein the at least one receiver is disposed in each of the outer connecting arms.

5. The shelf unit of claim 4, wherein the at least one support opening is disposed adjacent to each of the receivers, thereby facilitating an insertion of the at least one support into the shelf unit.

6. The shelf unit of claim 4, wherein the at least one flexible node is a plurality of flexible nodes, and each flexible node is disposed on each of the outer connecting arms and each of the inner connecting arms and the at least one node aperture is a plurality of node apertures, and each of the node apertures is adapted to receive each of the flexible nodes.

7. The shelf unit of claim 1, wherein the at least one cap is a first cap and a second cap, and the first cap is adapted to connect with the first end of the shelf body and the second cap is configured to connect with the second end of the shelf body.

8. The shelf unit of claim 1, wherein the at least one cap has at least one interlocking aperture formed therein for receiving at least one interlocking component to secure a first cap to an adjacent second cap.

9. The shelf unit of claim 8, wherein the at least one interlocking aperture is T-shaped and the at least one interlocking component is H-shaped, and a T-shaped portion of the at least one interlocking component is configured to be received by the at least one T-shaped interlocking aperture.

10. The shelf unit of claim 1, wherein each shelf body has at least one crossbar, and the at least one crossbar is disposed between the first end and the second end of shelf body.

11. The shelf unit of claim 10, wherein the at least one crossbar is hollow and the at least one connecting arm is configured to be disposed within the at least one connecting arm opening and the at least one crossbar.

12. The shelf unit of claim 11, wherein the shelf body has a center, and the crossbar has a first width adjacent to the second end of the shelf body and a second width adjacent to the center of the shelf body.

13. The shelf unit of claim 12, wherein the first width is greater than the second width, forming a tapered crossbar.

14. The shelf assembly of claim 1, wherein the flexible node is disposed between the two openings on a bridge-like portion of the at least one connecting arm.

15. The shelf assembly of claim 1, wherein the flexible node is circular and each of the two openings follows a portion of a circumference of the node.

16. A shelf assembly, comprising:

a shelf body having at least one connecting arm opening, at least one node aperture, and at least one support opening;

at least one cap having at least one connecting arm and at least one receiver, the at least one connecting arm configured to be disposed in the at least one connecting arm opening, the at least one connecting arm having at least one flexible node that is adapted to connect with the at least one node aperture forming an interference fit that allows the at least one cap to be removably connected to the shelf body, the flexible node having an edgeless uppermost surface that is disposed within the node aperture when connected therewith and accessible from an exterior of the shelf body so that the flexible node can be displaced from the node aperture and the at least one cap can be removed from the shelf body, wherein the at least one connecting arm includes two openings adjacent the at least one flexible node, the flexible node disposed between the two openings, the openings facilitating a movement of the flexible node;

a plurality of supports, the plurality of supports including a first support and a second support, each of the supports configured to be disposed in the at least one support opening and the at least one receiver, each support having a first end portion and a second end portion, the first end portion of the first support being adapted to connect with the second end portion of the second support; and a plurality of feet that are configured to connect with the at least one receiver of the at least one cap.

17. The shelf assembly of claim 16, wherein the at least one receiver has a ridge disposed therein, and each of the supports has a ledge adjacent to the first end portion and an outer edge adjacent to the second end portion.

18. The shelf assembly of claim 17, wherein the ledge of the first end portion and the outer edge of the second end portion are each configured to abut the ridge disposed in the receiver.

19. The shelf assembly of claim 16, wherein each of the feet includes an insert portion adapted to surround the first end portion of each of the supports, and an adjusting portion to selectively alter a height of the shelf assembly.

20. A kit for a shelf assembly, comprising:

a shelf body having at least one connecting arm opening, at least one node aperture, and at least one support opening;

at least one cap having at least one connecting arm and at least one receiver, the at least one connecting arm configured to be disposed in the at least one connecting arm opening, the at least one connecting arm having at least one flexible node that is adapted to connect with the at least one node aperture forming an interference fit that allows the at least one cap to be removably connected to the shelf body, the flexible node having an edgeless uppermost surface that is disposed within the node aperture when connected therewith and accessible from an exterior of the shelf body so that the flexible node can be displaced from the node aperture and the at least one cap can be removed from the shelf body, wherein the at least one connecting arm includes two openings adjacent the at least one flexible node, the flexible node disposed between the two openings, the openings facilitating a movement of the flexible node;

a plurality of supports, the plurality of supports including a first support and a second support, each of the supports configured to be disposed in the at least one support opening and the at least one receiver, each support having a first end portion and a second end portion, the first end portion of the first support being adapted to connect with the second end portion of the second support; and a plurality of feet that are configured to connect with the at least one receiver of the at least one cap.

* * * * *